United States Patent [19]

Anderson

[11] 4,113,108

[45] Sep. 12, 1978

[54] ADJUSTABLE BOOK HOLDING DEVICE

[75] Inventor: Lloyd R. Anderson, Fennville, Mich.

[73] Assignee: C-Line Products, Inc., Des Plaines, Ill.

[21] Appl. No.: 819,332

[22] Filed: Jul. 27, 1977

Related U.S. Application Data

[62] Division of Ser. No. 675,057, Apr. 8, 1976, abandoned.

[51] Int. Cl.[2] ..... A47B 65/00

[52] U.S. Cl. ..... 211/43; 108/28; 211/162; 211/184; 248/222.3

[58] Field of Search ..... 211/42, 43, 183, 184, 211/162; 248/222.2, 222.3, 500, 505, 288 B, 298, 223.4, 224.1, 224.2; 312/140, 233; 108/28, 60, 61

[56] References Cited

U.S. PATENT DOCUMENTS

| | | | |
|---|---|---|---|
| 1,363,138 | 12/1920 | Markham | 211/43 |
| 1,747,496 | 2/1930 | Vanderveld | 211/184 X |
| 2,291,250 | 1/1942 | Buchholz | 248/222.3 |
| 3,339,746 | 9/1967 | McCabe | 211/43 |
| 3,579,710 | 5/1971 | Gartzke | 211/184 X |
| 3,589,525 | 6/1971 | Allen | 211/184 X |

FOREIGN PATENT DOCUMENTS

| | | | |
|---|---|---|---|
| 1,339,711 | 9/1963 | France | 211/43 |
| 394,537 | 11/1965 | Switzerland | 211/43 |

*Primary Examiner*—Roy D. Frazier
*Assistant Examiner*—Terrell P. Lewis
*Attorney, Agent, or Firm*—Leydig, Voit, Osann, Mayer & Holt, Ltd.

[57] ABSTRACT

An adjustable book holding device adapted to support one or more groups of books, magazines, file folders, papers or the like in any desired spaced relation along an underlying panel which may be a shelf or tray. The device includes manually adjustable book supports adapted to bear against the outside books in each group. The book supports are longitudinally slidable and self-locking in response to lateral pressure from the books.

4 Claims, 13 Drawing Figures

ADJUSTABLE BOOK HOLDING DEVICE

This is a division of application Ser. No.675,057, filed Apr. 8, 1976, now abandoned.

DESCRIPTION OF THE INVENTION

The present invention relates to book holding devices in general and, more specifically, to an adjustable book holder adapted to support one or more groups of books, magazines, file folders, papers, or the like in any desired spaced relation along an underlying shelf or tray. The term "book" as used herein is meant to include hard cover books, paperbacks, magazines, brochures, catalogs, file folders, loose sheets of paper, phonograph records, and other objects adapted for storage on book shelves.

One object of the present invention is to provide an adjustable book holder of the type adapted to support two or more groups of books in upright position and in any desired spaced relation to each other along an underlying support panel.

Another object of the invention is to provide an adjustable book holder adapted to support a single book or group of books in upright position at any desired position along an underlying support panel.

A further object is to provide an adjustable book holder of the character set forth adapted to support in upright position hard cover books, paperbacks, magazines, brochures, catalogs, file folders, or loose sheets of paper, in single or multiple groups, all with equal facility. A related object is to provide a device of the foregoing type adapted to support effectively various combinations of the books and publications just mentioned.

Other objects and advantages will become apparent from the following detailed description, taken together with the accompanying drawings, wherein.

Figure 1:
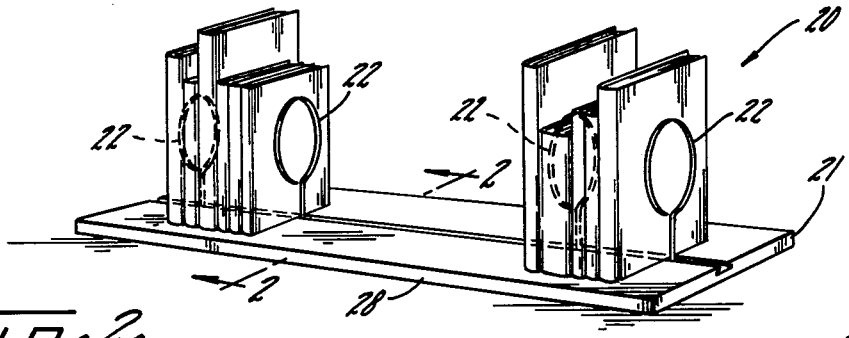
FIG. 1 is a perspective view of an adjustable book holder illustratively embodying the present invention.

While the invention is susceptible of various modifications and alternative constructions, certain illustrative embodiments have been shown in the drawings and will be described below in considerable detail. It should be understood, however, that there is no intention to limit the invention to the specific forms disclosed but, on the contrary, the intention is to cover all modifications, alternative constructions, and equivalents falling within the scope of the appended claims.

Referring more specifically to FIG. 1, the invention is there exemplified in an illustrative book holder 20 adjusted in this instance to support two groups of books in spaced relation with each other along an underlying support panel 21. The support panel 21, which may be either a book shelf or supporting tray, is provided with a plurality of longitudinally slidable, self-locking book supports 22 adapted to bear against the outside books in each group. In this case, the support panel 21 happens to be formed as a tray of wood or plastic and is provided with a bottom pad 24 to protect the surface of an underlying desk or table.

For the purpose of receiving and engaging the book supports 22, the support panel 21 is fashioned with a longitudinal guideway 25 situated generally centrally thereof and having an inverted T-slot cross section. This defines an upper wall, a lower wall spaced therefrom, and opposed side walls connected therebetween. The guideway 25 in this instance is formed as a recessed channel having opposed. in-turned side flanges 26 with a transverse gap therebetween. The flanges 26 are substantially flush with the top surface 28 of the support panel 21 and they straddle the depending shank 29 of the book support. The channel guideway 25 is adapted to slidably receive the shank 29 and a generally rectangular support base 30 welded or otherwise rigidly fixed thereto. The support base 30, which may be fashioned as a relatively heavy sheet metal stamping, has a lateral dimension and a thickness sufficient to provide a running clearance with the opposed inside vertical and horizontal walls of the channel guideway 25. It has a longitudinal dimension somewhat greater than its lateral dimension. Lateral pressure of a book or group of books against the book support 22 creates a tendency toward frictional binding between diagonally opposed end edges of the support base 30 and the bottom wall 33 of the channel guideway 25 and its top wall which is defined by the in-turned side flanges 26.

Figure 4:
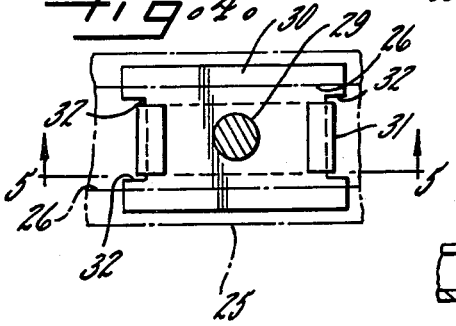
FIG. 4 is a further enlarged fragmentary horizontal sectional view taken in the plane of the line 4—4 in FIG. 3 and showing the support base in plan.
Figure 5:
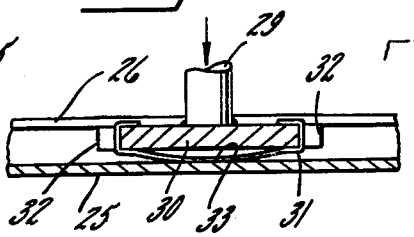
FIG. 5 is an elevational view of the support base taken in the plane of the line 5—5 in FIG. 4.

In accordance with a further aspect of the invention, provision is made for enhancing the self-locking action between the support base 30 and channel guideway while permitting the support to be readily adjusted along the guideway by manually gripping the shank 29. Referring more specifically to FIGS. 4 and 5, this may be accomplished by the use of a resilient element in the form of a leaf spring 31 underlying the support base 30 and having reversely bent end portions recessed in opposed notches 32 in the support base. The spring 31 is disposed longitudinally of the support base 30 and guideway channel 25. It is bent in close conformity to the thickness of the support base 30 in the region of the notches 32, leaving a long bowed section underlying the bottom of the support base. As shown particularly in FIG. 5, the spring 31 is disposed so as to bear against the bottom wall 33 of the guideway, normally urging the support base 30 upwardly against the guideway flanges 26. This develops strong frictional engagement between the upper surface of the support base 30 and the undersurfaces of the guideway flanges 26, and between the spring 31 and the bottom guideway wall 33. In this position, the support base 30 effectively resists sliding movement due to lateral book pressure on the support 22 and is thus locked in position. When it is desired to adjust the book support 22 to a new position along the guideway, it is only necessary to push down manually on the support 22, reducing or eliminating the frictional resistance between the flanges 26 and the support base 30 and readily permitting longitudinal adjustment of the book support against the frictional drag along the bottom wall 33.

Figure 6:
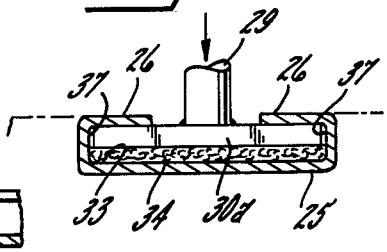
FIG. 6 is a view somewhat similar to FIG. 5 but illustrating a modified form of support base and showing the associated guideway channel in vertical section.

A further modification is illustrated in FIG. 6 wherein the support base 30 is formed with a lamination of resilient material 34 such as felt or rubber on its underside. The resilient material 34, like the spring 31, normally urges the support base 30 upwardly into frictional contact with the undersurfaces of the guideway flanges 26. In this position, shown in FIG. 6, the book support 22 is in its locked position where it resists lateral pressure from the books. In order to adjust the support 22 to a new position along the guideway, one has only to exert downward pressure on the support along with a moderate force longitudinally of the guideway. This compresses the resilient lamination 34, reducing or eliminating the frictional contact with the guideway flanges 26 and permitting easy manual adjustment of the book support against the frictional drag of the lamination 34 along the bottom wall 33.

Figure 7:
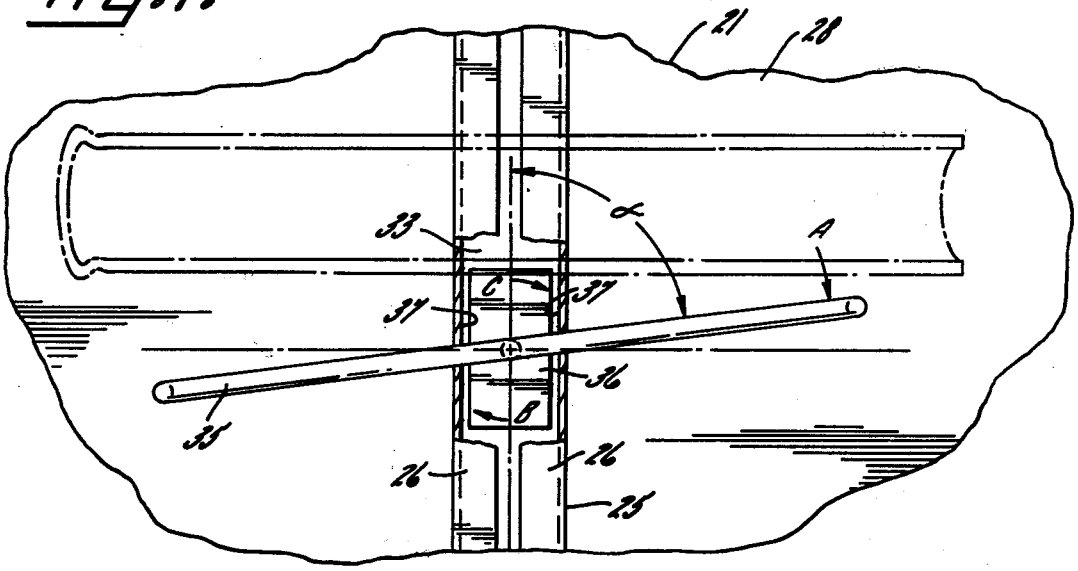
FIG. 7 is a plan view illustrating an alternative form of book support having an angularly offset support base and also embodying the invention.
Figure 8:
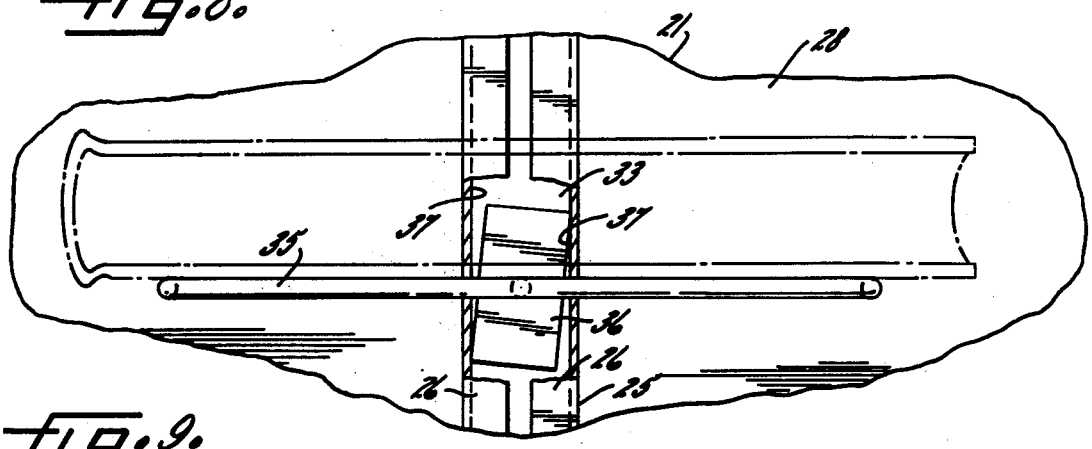
FIG. 8 is a view similar to FIG. 7 but showing the book support in its locked position normal to the guideway channel.
Figure 9:
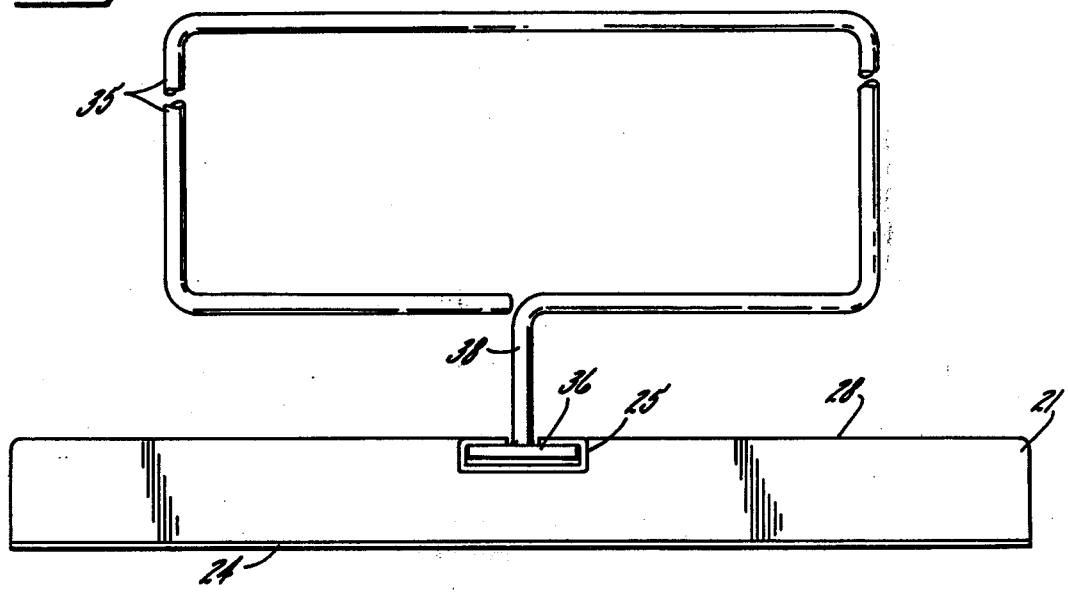
FIG. 9 is an end elevational view illustrating an adjustable book holder utilizing the book support shown in FIGS. 7 and 8.

Turning next to FIGS. 7, 8 and 9, there is shown still another modification of an adjustable book holder also embodying the invention. The device as shown utilizes a support panel 21 and longitudinal guideway 25 with in-turned flanges 26 similar to those components described above. In this instance, however, book support 35 is secured to generally rectangular support base 36 having a width slightly less than the internal width of the guideway and which is shown with somewhat exaggerated clearance for purposes of clearer illustration. The plane of the book support 35 is disposed at a slightly skewed angle $\alpha$ rather than at 90° to the general plane of the book support. The angle $\alpha$, which is shown in exaggerated form for purposes of clearer illustration, may be on the order of 3° to 5°. Its size is limited by the maximum skew of the support base 36 about its horizontal center that can occur between the opposed side walls 37 of the guideway. When the support base is inserted into the guideway 25 in the support panel 21, the book support 35 may readily be adjusted to any desired position manually. The book support 35 becomes self-locking in response to lateral pressure of a book tending to urge the book support into a plane normal to the longitudinal axis of the guideway 25. Turning of the book support 35 in response to lateral book pressure results in skewing the support shank 38 and base 36 through the angle $\alpha$ inside the guideway, creating binding frictional contact between diagonally opposite corner portions of the support base 36 and the opposed inner vertical walls 37 of the guideway channel. The frictional resistance thus created is sufficient to lock the book support 35 in adjusted position.

Figure 2:
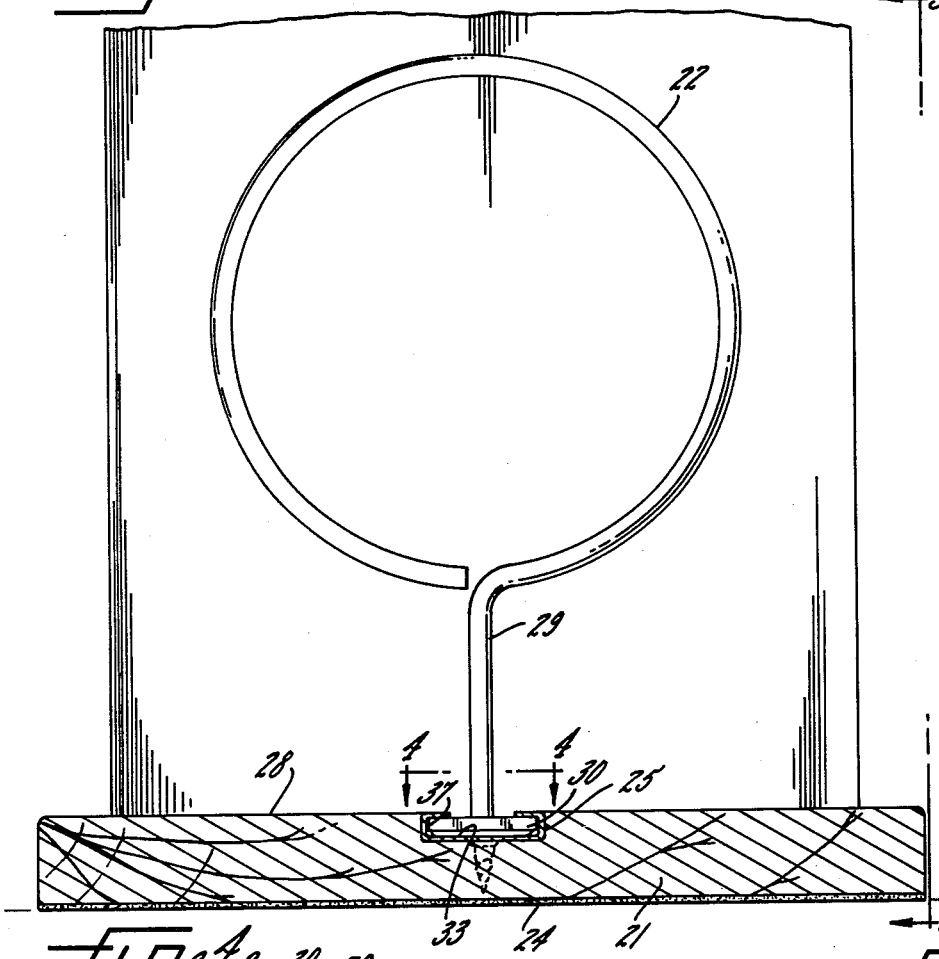
FIG. 2 is an enlarged and elevational view of the book holder illustrated in FIG. 1.
Figure 3:
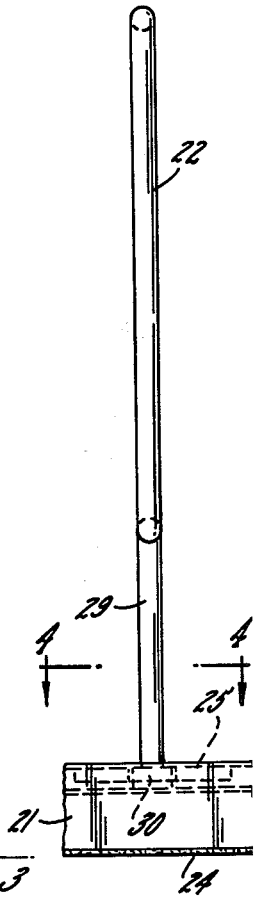
FIG. 3 is a side elevational view of a portion of the book holder, taken in the plane of the line 3—3 of FIG. 2.
Figure 10:
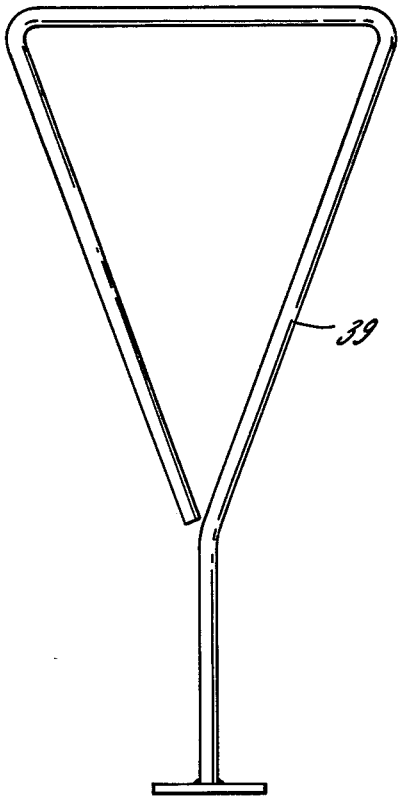
FIG. 10–13 are elevational views of various alternative forms of book support adapted for use in the book holders of FIGS. 1 and 9.
Figure 11:
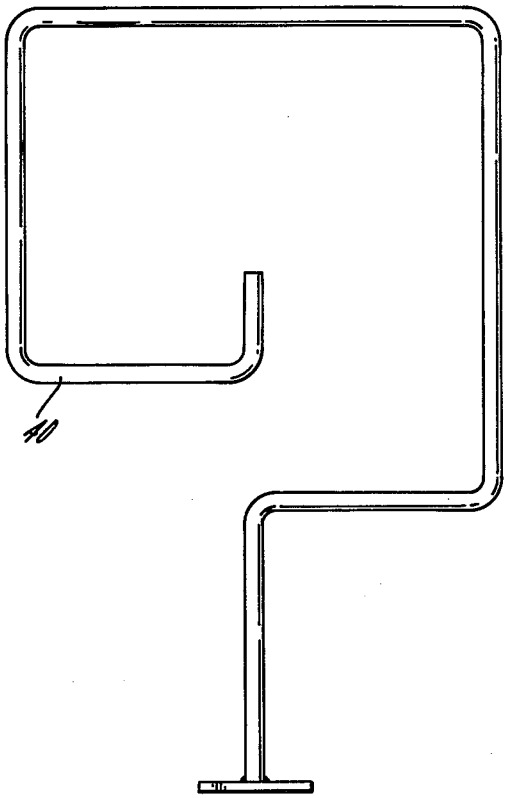
Figure 12:
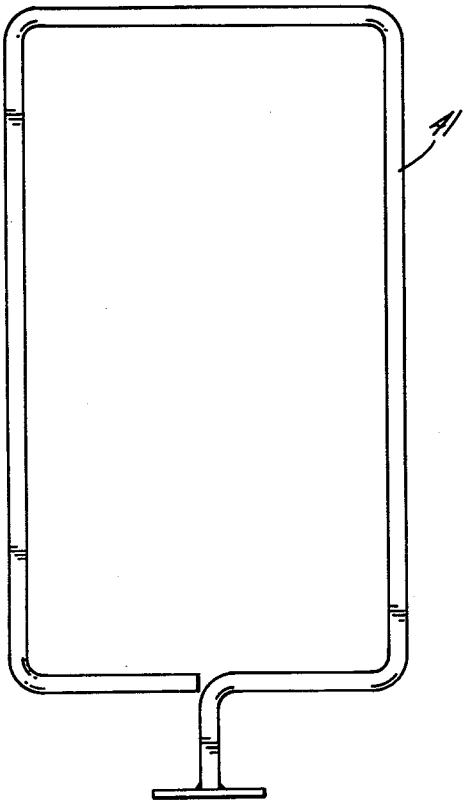
Figure 13:
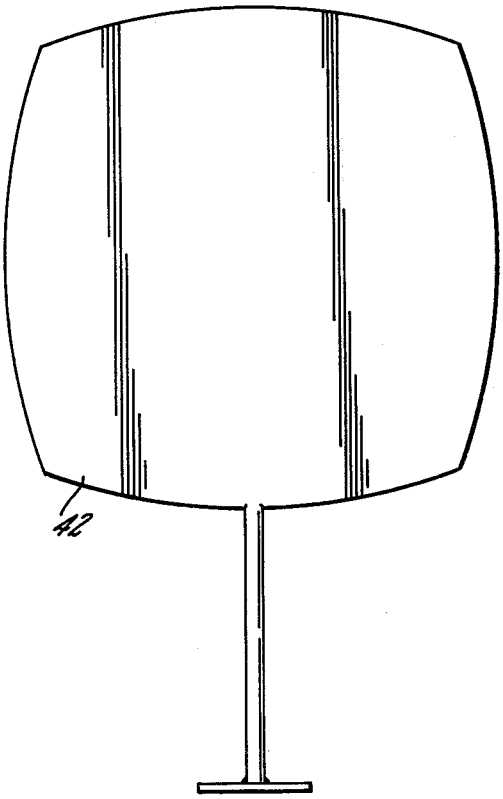

The book supports 22 and 35 may assume a variety of shapes and still function as described earlier herein. Referrring, for example, to FIGS. 2 and 10–13, they may be formed of heavy wire or light bar stock with a circular shape as shown in FIG. 2, a triangular shape 39 as shown in FIG. 10, or various rectangular shapes 40, 41 as illustrated in FIGS. 11 and 12. On the other hand, the book supports may be fashioned as panels of wood or plastic 42, shown in FIG. 13. Each of the book supports is substantially centered on the rod or wire shank connecting it to the support base. In dimensioning the book supports, it is important that they have sufficient height and width to engage the variety of books or other items that are to be stored in the book holding device.

I claim as my invention:

1. An adjustable book holding device comprising, in combination:

(a) a support panel having a longitudinally extending guideway recessed therein;

(b) said guideway having an upper wall and a lower wall spaced therefrom and opposed side walls connected therebetween;

(c) a pair of opposed guideway flanges disposed in laterally spaced relation with each other and defining the upper wall of said guideway;

(d) at least one pair of upstanding book supports slidably mounted in said guideway and having a generally planar book engaging portion to abut against one or more books standing upright on said panel;

(e) each said book support having a depending shank adapted to slide freely between said opposed guideway flanges;

(f) a support base of generally rectangular form slidable generally along its longitudinal axis in said guideway and having a lateral dimension substantially less than that between the opposed side walls of said guideway; and (g) said support base being fixed to said shank with its longitudinal axis skewed relative to the general plane of said book support, whereby diagonally opposed corner portions of said support base are driven into frictional locking engagement with said guideway side walls in response to lateral pressure from said books.

2. The combination set forth in claim 1 wherein:

(a) said support base is adapted to be skewed about its center between said guideway side walls so that its longitudinal axis defines an acute angle with the longitudinal axis of said guideway; and (b) said support base is fixed to said shank with the longitudinal axis of said support base skewed at said acute angle with respect to the general plane of said book support.

3. The combination set forth in claim 1 wherein said guideway is defined by a channel recessed in said support panel.

4. The combination set forth in claim 1 wherein each said book support is substantially centered upon its depending shank.

* * * * *